United States Patent [19]

Held

[11] Patent Number: 4,738,029

[45] Date of Patent: Apr. 19, 1988

[54] NUMERICALLY OR MANUALLY CONTROLLED MOVING CARRIAGE DRAFTING MACHINE

[76] Inventor: Kurt Held, Alte Strasse 1, D-7218 Trossingen 2, Fed. Rep. of Germany

[21] Appl. No.: 825,680

[22] Filed: Jan. 31, 1986

Related U.S. Application Data

[63] Continuation-in-part of Ser. No. 478,904, Mar. 25, 1983, abandoned.

[30] Foreign Application Priority Data

Mar. 26, 1982 [DE] Fed. Rep. of Germany ..... 3211174

[51] Int. Cl.[4] ..... B43L 13/00

[52] U.S. Cl. ..... 33/18.1; 33/1 M; 33/438

[58] Field of Search ..... 33/1 M, 438, 125 M, 33/436, 18.1

[56] References Cited

U.S. PATENT DOCUMENTS

| | | | |
|---|---|---|---|
| 4,237,617 | 12/1980 | Goussios | 33/1 M |
| 4,241,512 | 12/1980 | Chikanobu et al. | 33/438 |
| 4,268,969 | 5/1981 | Koenuma | 33/438 |
| 4,370,811 | 2/1983 | Triggs et al. | 33/1 M |
| 4,386,470 | 6/1983 | Perry | 33/438 |
| 4,430,797 | 2/1984 | Eder | 33/438 |
| 4,455,751 | 6/1984 | Held | 33/18.1 |

*Primary Examiner*—William D. Martin, Jr.

*Attorney, Agent, or Firm*—Toren, McGeady & Associates

[57] ABSTRACT

A numerically or manually controlled moving carriage drafting machine with digital X-Y position and angle indication, input keyboard, ruler holder and lowering mechanism for tubular pens or similar writing instruments at the drawing head is particularly characterized in that the drawing head contains an $X_1$–$Y_1$ writer with high dynamic range and small working range only for lettering and small sized symbols whose path instructions are superimposed by the same computer alternately also to the X-Y drives of the moving carriages, and that all movements of the drawing head originate as selected from a movement sensor which is guided manually by the hand of an operator as well as from a path computer, with all operating and path driving programs at least capable of being recalled from the keyboard at the drawing head.

8 Claims, 5 Drawing Sheets

NUMERICALLY OR MANUALLY CONTROLLED MOVING CARRIAGE DRAFTING MACHINE

This is a 1.62 continuation-in-part of application Ser. No. 478,904 filed Mar. 25, 1983, now abandoned.

The present invention relates to a moving carriage drafting machine having a drafting head, digital X-Y position and angle indicating means, an input keyboard, a ruler holder and a lowering mechanism for tubular pens or similar writing instruments at the drawing head.

In computer-assisted moving carriage drafting machines, the path information is given in the form of analog digital values of Cartesian coordinates of the path points to the drives, wherein the path determination takes place by means of a computer which is informed of the path description by programming in a suitable, usually higher programming language.

However, computer-assisted drafting machines should also enable the designer to work during the design process as usual with rulers, which are attached in the drawing head and are manually positioned on the drawing surface, as well as to work with the aid of the computer during the execution of easily describable or once and for all described drawing operations which are difficult to execute. Due to the equipment of the machine, the designer should at any time be able to abbreviate parts of his construction to support points of a path to be moved over later, to use routine programs for execution of, for instance, repetitive parts of his design, to experimentally undertake position fixing, for instance, for optimization of specific conditions, to shade sections of surfaces, to undertake as desired divisions of circles or distances or similar operations.

The state of the art is well characterized by a product commercially available from Wild Heerbrugg AG, CH-9435 Heerbrugg, wherein all movements and paths to be performed by the drawing head carriage must be programmed by means of a computer which is connected by means of an RS 232 converter with the axial drive of the moving carriage drafting machine.

In accordance with the present high efficiency of the programs which are available in the control computer used, such automatic drafting machines are used for the development of extensive linework and for the representation of complex designs in the most varied views and section paths. This state of the art is also characterized in brochures available from such commercial companies as Aristo, Calomp and Xynetics.

Characterizing this state of the art are the high intellectual requirements imposed on the designer by operation of these machines which lead in complicated drawing operations to the partial or complete loss of the overview over the linework programs. However, this leads in any case to heavily increasing document expenditure and consequently to an impairment in the productivity of the efficiency of the human operator and of the machine. The major part of all design work in general engineering is therefore still done even today at drafting boards and drafting machines whose function has been unchanged for decades.

The decisive disadvantage of the existing state of the art consists in that, due to spatially,far removed elements, conventional CAD devices make it necessary for the designer to perform unaccustomed bodily movements which interfere with concentration and adaptations of the eye to alternating object distances which cause considerable psychological stress.

The present invention is directed toward the task of arranging elements of conventional, manually guided drafting machines, as well as of conventional numerically controlled or computer controlled drafting machines, as well as elements of so-called plotters or lettering machines in such a way that the designer receives effective assistance of high productivity in his work whose use is obvious for him because he is not required to understand complex computer programs, but only needs an overview over the linework which represents the design or the plan.

It is of decisive importance to arrange the movement sensor, digital indicator, computer keyboard, $X_1$-$Y_1$ driving mchanism, for instance, according to U.S. Pat. No. 4,197,550, adjusting magnifier, printing (or pressure) pencil, as well as an advantageous selection of tubular pens closely together and in the direct range of vision of the operator of a moving carriage drafting machine according to the present invention.

SUMMARY OF THE INVENTION

The present invention may be described as an improvement in numerically or manually controlled moving carriage drafting machines. The machine, in accordance with the invention, is provided with a drawing head, moving carriages, X-Y drives of said moving carriages, a movement sensor, digital X-Y position and angle indication means, an input keyboard, ruler holder means, rulers and a lowering mechanism for tubular pens or similar writing instruments at said drawing head. In accordance with the invention, an improvement is provided comprising that said drawing head contains an $X_1$-$Y_1$ writer with high dynamic range and small working range only for lettering and small sized symbols whose path instructions are superimposed by the same computer alternately also to the X-Y drives of the moving carriages, that all movements of said drawing head originate as selected from the movement sensor which is guided manually by the hand of the operator as well as from a path computer, and that all operating and path driving programs can at least be recalled from the keyboard at said drawing head.

According to the invention, the drafting machine has controllable drives in the X and Y direction which receive their desired values from a preprogrammed analog or digital computer or from a guide sensor. A conventional moving carriage drafting machine is equipped in the X and Y axis with low mass drives of high dynamic range which convert to driving movements, the driving signals generated from path outlines either by means of the hand of the operator at the movement sensor of the drafting machine or by the computer of the machine control.

The drawing head of the moving carriage drafting machine which is thus variable and which, as is known, is provided with a receptacle for two rulers arranged at right angles to one another, receives not only a movement sensor, but in additional thereto, a keyboard as input in the control computer and a second, firmly installed $X_1$-$Y_1$ driving mechanism, for instance, according to U.S. Pat. No. 4,197,550, a cathode-ray tube as computer-controllable data output, a centering magnifier, a printing pencil, as well as an advantageous number of tubular pens of different line widths.

In order to economically manufacture this inventive arrangement of partially known,partially new auxiliary means for engineering design, it may be advantageous to superimpose the control and evaluation electronics of the moving carriage axes to the $X_1$-$Y_1$ driving mechanism as long as the path is followed and to switch them back to the X-Y driving mechanism if they are needed there.

In addition, it may be advantageous to also construct the support of the ruler receptacle to be rotatable by a motor in order to process as in the X-Y or the $X_1$-$Y_1$ drives a control signal, generated manually or by the computer, for the defined rotation of the ruler receptacle.

In accordance with another embodiment of the invention, in the drawing head of a moving carriage drafting machine with distance or location measuring X-Y drives, all input and output elements are arranged closely adjoining in a space in the direct range of vision of the operator. This applies to the elements which are required when working with the computer and for the stepwise production of a draft and final drawing at the same location, i.e., on the same drawing board. In addition, a further embodiment consists in that the operating programs of the machine which are accessible by means of the keyboard at the drawing head permit the simple incorporation of position location data, obtained by means of manual processes, and adjustment of the drawing head with the movement sensor, of each individual output and input tool, such as the $X_1$-$Y_1$ writer, intersection of drawing edges of the pair of rulers, optical axis of the centering mangifier, pencil or tubular pen axes.

The advantages which can be achieved with the inventive arrangement consist particularly in that the arrangement also ideally adapts to the natural developmental process of an engineering design at the drawing board. The movement sensor at the drawing head gives the drafting machine the behavior of a conventional, undriven moving carriage drafting machine as long as the operator does not desire computer assistance, wherein however, the position data of interesting output or input tools can be available at the indicator.

The drawing head behaves differently in an advantageous manner when the movement sensor is released. Since it supplies no driving signals, the drawing head and consequently the drawing edges of the rulers stand still. The location of the drawing edges or any other output tool can be followed in the digital indicator and can be taken over in the computer as support points of a path driving program to be developed.

When the working process requires computer assistance, for instance, for divisions, circles, trigonometrical determinations or for the execution of standardized representation elements, then computer assistance can be recalled via the keyboard, it can be checked on the indicator, and can be performed with any available drafting tool. Execution and progress of this system assistance takes place in the easily observable range of vision of the operator who can accelerate, delay or interrupt the execution by means of the keyboard.

Particularly when stored representation elements which are variable in size, shape or scale are to be inserted correctly into the drawings or plans, the possibility to position with the movement sensor and the adjusting magnifier sensitively in the working area, i.e., in the drawing or plan, and to assign the execution to the required tool, which can be positioned only with difficulty or inaccurately optically with the control instruction is extremely productive.

The same applies to repetitive or non-recurrent texts when the placement in the drawing is critical or narrow or characterized by always alternating space supply. Here, the simple positioning by means of the movement sensor and the restriction of the describable surface can be very time-saving due to information of the limits. Drawings in final form from outlines, sections, shadings, axonometric representations can be performed similarly effectively by interaction between machine and human being.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE PREFERRED EMBODIMENT

Figure 1:
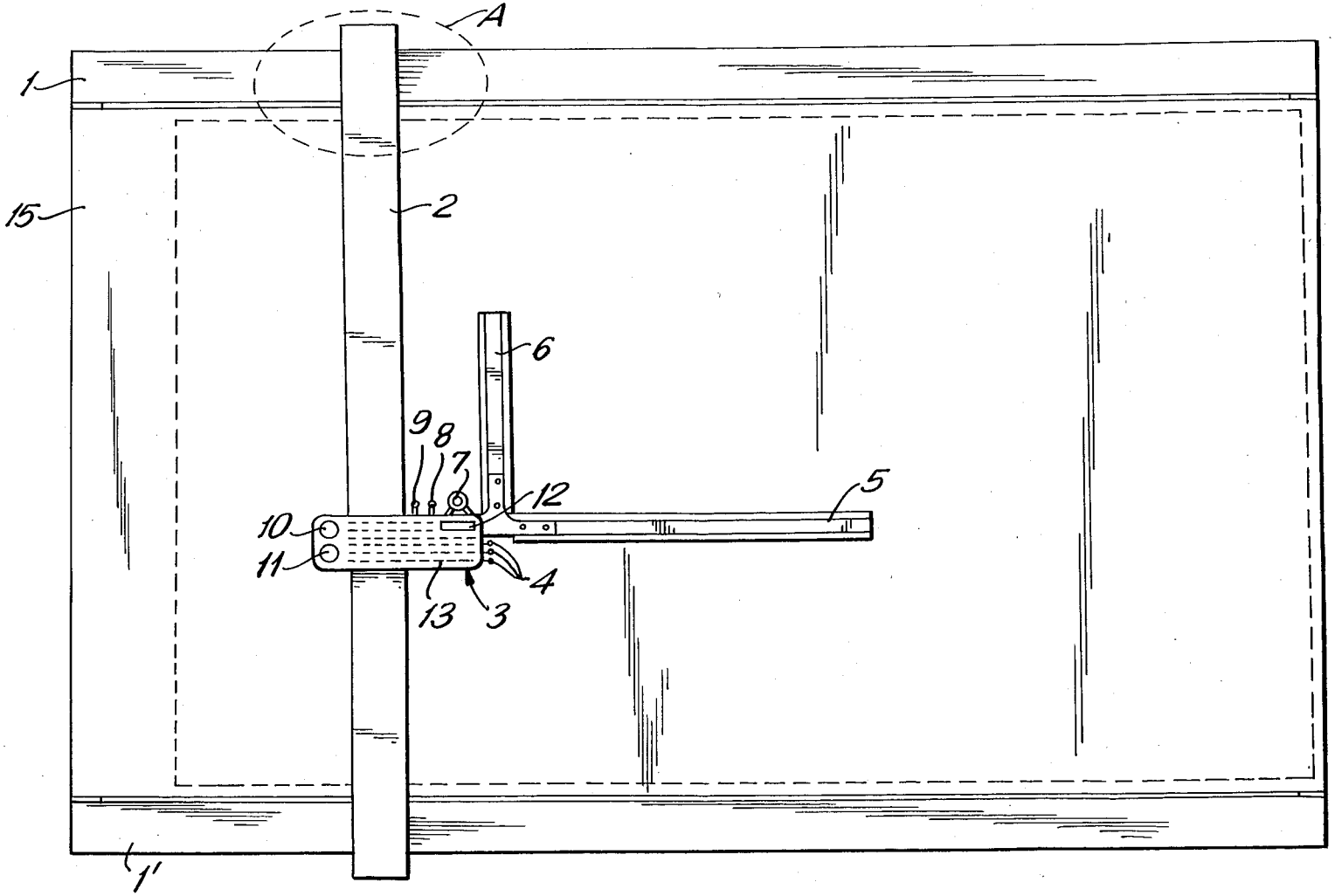
FIG. 1 is a plan view of the computer-assisted drafting machine according to the invention.

Referring to the drawings, there is shown a drafting machine in accordance with the invention which comprises a horizontal guide path 1 containing a guide carriage driven, for instance, according to U.S. Pat. No. 4,455,751. At the guide carriage, the guide path 2 is attached in a rigid and bend-resistant manner. The guide path 2, as the guide path 1, contains guide carriage (not shown) at which the drawing head 3 is attached. Here, the guide path 1 represents the X-axis, and the guide path 2 the Y-axis of the drafting machine. The guide path 1 in turn is attached, for instance, at a drawing board 15, as is generally known, and the drawing board is set up so as to be capable of being inclined or held rigidly at an advantageous height before the draftsman.

The drawing head 3 at the moving carriage of the guide path 2 contains for operation with the left hand the movement sensor 11 which is sensitive to vectorial pressure in the driving direction and the torque-sensitive rotation sensor 10 for generation of the driving signals, for movement of the drawing head 3 or for rotation of the angle at which rulers 5, 6 are set. In addition, on the front surface of the drawing head, facing the operator, there is the keyboard 13, as well as a matrix point or cathode-ray tube display 12.

Facing away from the hand of the operator, however, in the near range of vision of the operator and activated by the lifting mechanism in the interior of the drawing head, there is an $X_1$-$Y_1$ driving mechanism 7, a pencil holder 8, an adjusting magnifier 9, as well as, for instance, tubular pens 4 of different line thicknesses which may be arranged, for instance, according to U.S. Pat. No. 4,455,751.

Figure 2:
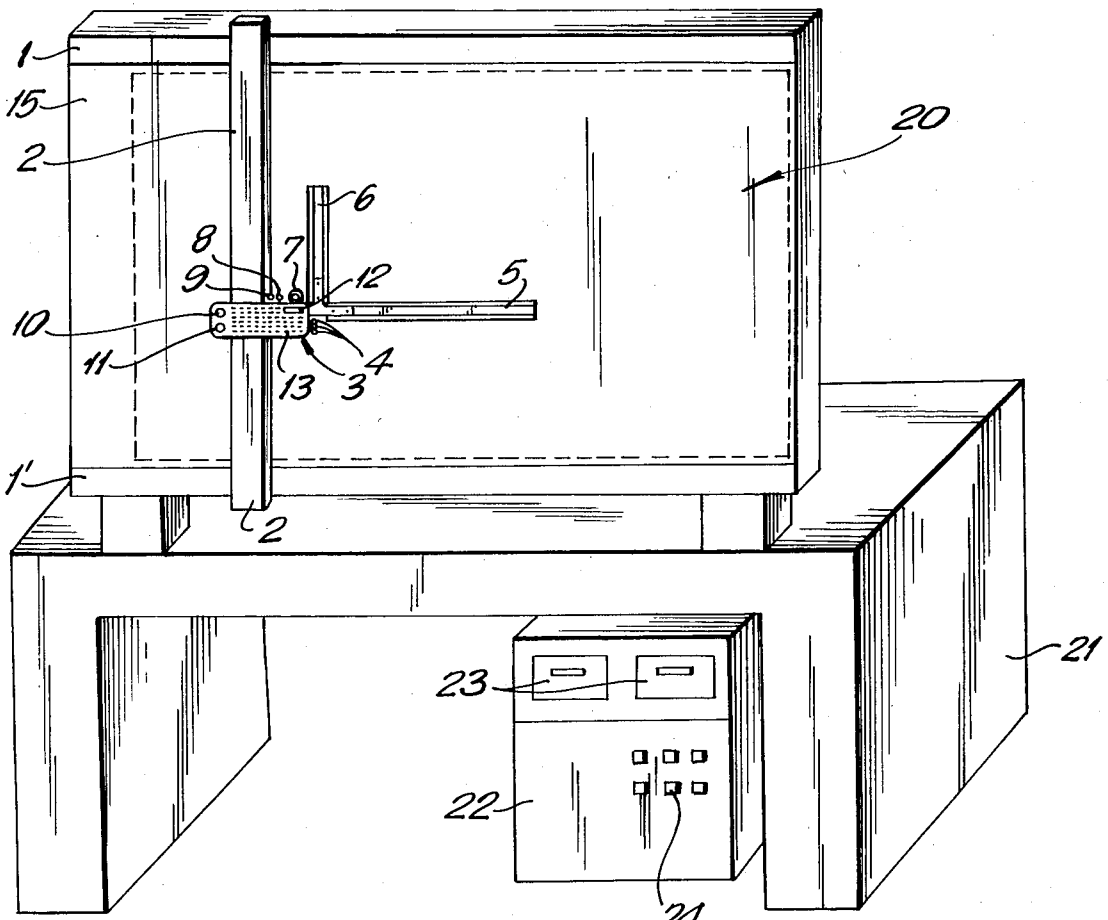
FIG. 2 is a perspective view of the computer-assisted drafting machine shown in connection with a computer mounted on a table.

FIG. 2 shows a numerically controlled drafting machine 20 of the type shown in FIG. 1, according to the invention, which is mounted on a table 21. The drafting machine includes a drafting board 15 which is set up so as to be tiltable or fixed at an advisable height in front of the draftsman. At the underside of the table 21 is located a computer 22 comprising two disk drive mechanisms 23 for storing data and keys 24 mounted at the front side for operation. In addition, the computer 22 comprises the interfaces necessary for controlling the different drives of the drafting machine 20, which comprises two drives acting in the X- and Y- directions so that the drafting head 3 and the rulers 5 and 6 attached thereat can move to any desired position on the drafting board 15 by control of the drives. The construction of the drives may be in accordance with, for example, the disclosure of U.S. Pat. No. 4,455,751, which is incorporated herein by reference, wherein a carriage equipped with toothed wheels runs on a toothed rack. In addition, the horizontal guide path 1 along the upper border of the drafting board 15 consists of a toothed rack.

Figure 3:
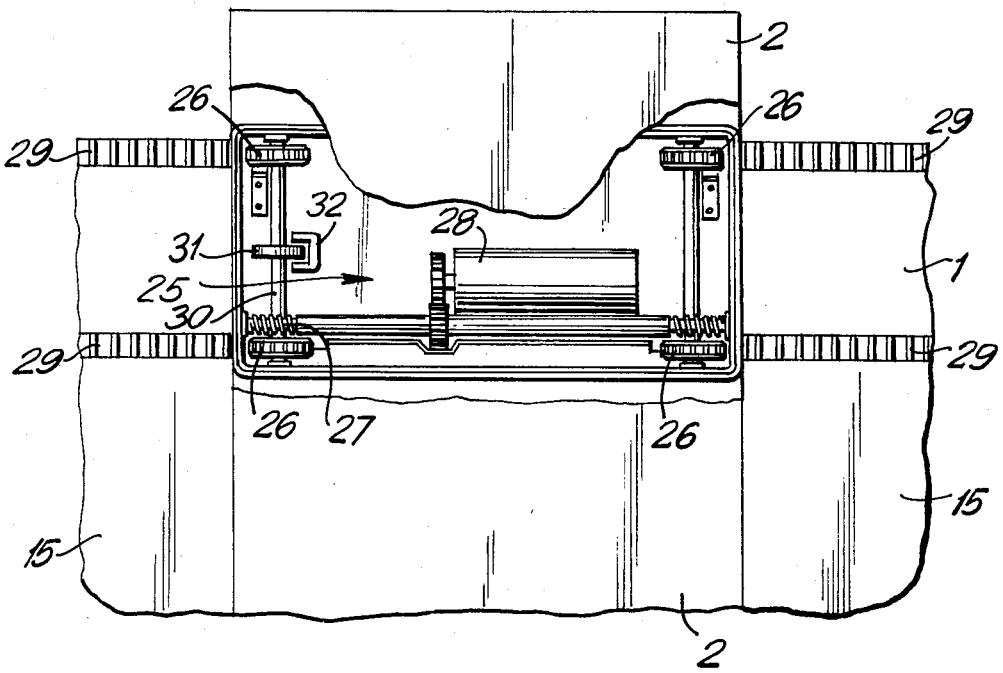
FIG. 3 is a detailed view partially broken away taken at point A in FIG. 1.

As shown in FIG. 3, a guide carriage 25 is attached at the underside of the guide path 2, so that the guide path 2 is fastened at the guide carriage 25 in a rigid and bendingresistant manner. This guide carriage 25 comprises four toothed wheels 26 which are driven by a motor 28 by means of a worm 27. The toothed wheels 26 mesh on the teeth 29 of the toothed rack comprising the horizontal guide path 1 and, accordingly, they move the guide carriage 25 and the guide path 2 in the horizontal direction, i.e., in the X- direction. The motor and the movement of the toothed wheels is controlled by means of an electronic control of the computer (known, per se, for example, according to the disclosure of U.S. Pat. No. 4,197,550, incorporated herein by reference), in such a way that the desired X- position on the drafting board 15 is reached.

Should the movements on the X- axis be characterized by a particular dynamic range, this described X-Y-drive can also be expanded in that a toothed rack is arranged not only in the upper part of the drafting machine at 1, but also in the lower part at 1'. The guide path 2 then additionally obtains in its lower part 1' a carriage provided with toothed wheels and a motor, wherein the ring angle between 1, 1' and 2 is likewise ensured, like the parallel displacement of guide path 2, during each acceleration and delay provided for the operation. Accordingly, an arrangement for movement in the X- direction consisting of two drives is obtained. Better acceleration values are achieved for the movement of the guide path 2 by means of the second drive, i.e., the desired X- coordinate can be reached more rapidly.

Similarly located on the guidepath 2 is a toothed rack on which the drafting head 3 moves in the Y- direction, a guide carriage with toothed wheels likewise being located in the drafting head 3. This guide carriage is constructed exactly as described above with reference to FIG. 3. The desired Y- position is similarly reached with the aid of an electronic control.

Guide path 1 represents the X- axis, and guide path 2 the Y- axis of the drafting machine.

Figure 4A:
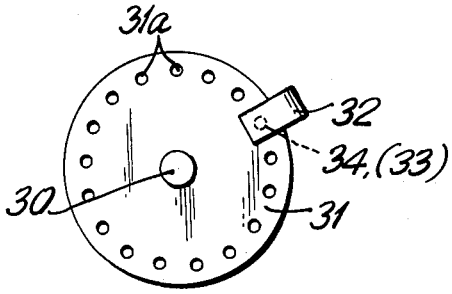
FIGS. 4*a* and 4*b* are, respectively, a plan view and a sectional view showing the angular pulse transmitter for determining position.
Figure 4B:
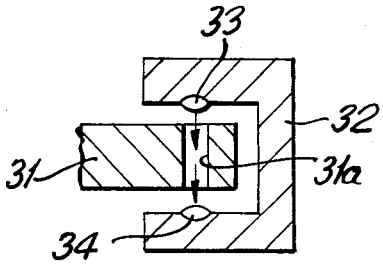

Accurate movement to the X- or Y- position is effected, as in the prior art, by means of sensors which determine the respective position on the drafting board 15. Such sensors can be constructed as angular pulse transmitters provided on the motor axle or on a toothed wheel of the drive and can supply a pulse after reaching a determined angular increment. As shown in FIG. 3, a perforated disk 31 is mounted on the axle 30 of a toothed wheel pair 26, 26, which perforated disk rotates along with this axle 30. This disk 31 is shown in enlarged scale in FIG. 4*a*. At the border of the circumference, it comprises continuous holes 31*a* which are angularly spaced at equal distance from one another. At the border of the disk 31, a bifurcated photocell 32 is arranged in such a way that the light emitted from a transmitter 33 passes through a borehole 31*a* and strikes a receiver 34 (see FIG. 4*b*) when a hole 31*a* is located precisely between the transmitter and receiver. This light triggers a pulse in the receiver 34 which is amplified and fed to the corresponding interface in the computer 22.

Accordingly, individual consecutive pulses are obtained during the rotation of the axle 30. By counting these pulses by means of a counter, the electronic control in the computer 22 can calculate the respective X-Y- coordinates actually reached by means of conversion with the transmission ratio of toothed wheel 26 and worm 27. If a determined position is reached, the X- Y- coordinates of the desired value are fed into the control and the drives are switched on until the coordinates of the actual position coincide with those of the desired value.

Figure 5:
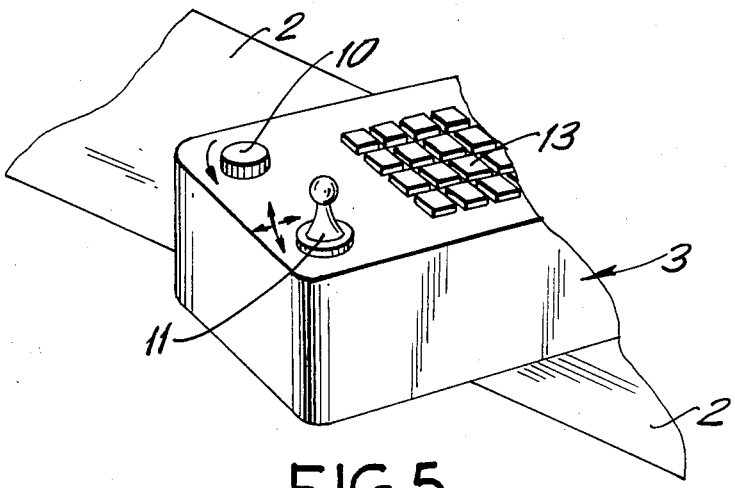
FIG. 5 is a partial perspective view showing a part of the drafting head with movement sensor and rotation sensor.

Instead of feeding a determined desired value into the control, and moving until the desired value coincides with the actual value, the movement of the drafting head can also be started without moving to a determined point which is established by means of coordinates. The drafting head then moves as long as a switch is actuated for driving the drafting head. The direction in the sense of the X- Y- coordinates, i.e., the inclination of the straight lines on which the drafting head 13, moves, is determined by means of the position of this switch. Such a switch, provided at the drafting head 3 at the moving carriage of the guide path 2 and operable with the left hand, constitutes the movement sensor 11 which is sensitive to vectorial pressure in the movement direction. As shown in FIG. 5, this movement sensor 11 is constructed in the manner of a joystick, which reacts to pressure in determined directions and transforms this pressure into electrical signals by means of an electronic evaluating device. These signals are transmitted from the computer 22 to the control of the motors for the drive in the X- and Y- directions so that the drafting head 13 moves in the direction corresponding to the position of the movement sensor 11.

The drafting head 3 is rotatably fastened at the guide path 2 so that the entire drafting head, including the rulers 5, 6, may be turned through a desired angle. This rotation is likewise effected by a motor by means of an electronic control and it can be controlled manually by turning the torque-sensitive rotation sensor 10. Such a rotation sensor consists of a known rotation angle indicator transmitter which determines the respective angular position of the turning knob 10 (see FIG. 5) by means of light emitting diodes and phototransistors and transmits it to the control of the motor for effecting the indicated rotation. The drafting head 13 is then rotated by means of the motor until it has likewise reached the angle adjusted or set by means of the turning knob. In addition, the keyboard 13 as well as the matrix point or cathode-ray tube displays 12 are provided on the front surface of the drafting head 3 on the operating side, as shown in FIG. 1.

Figure 6:
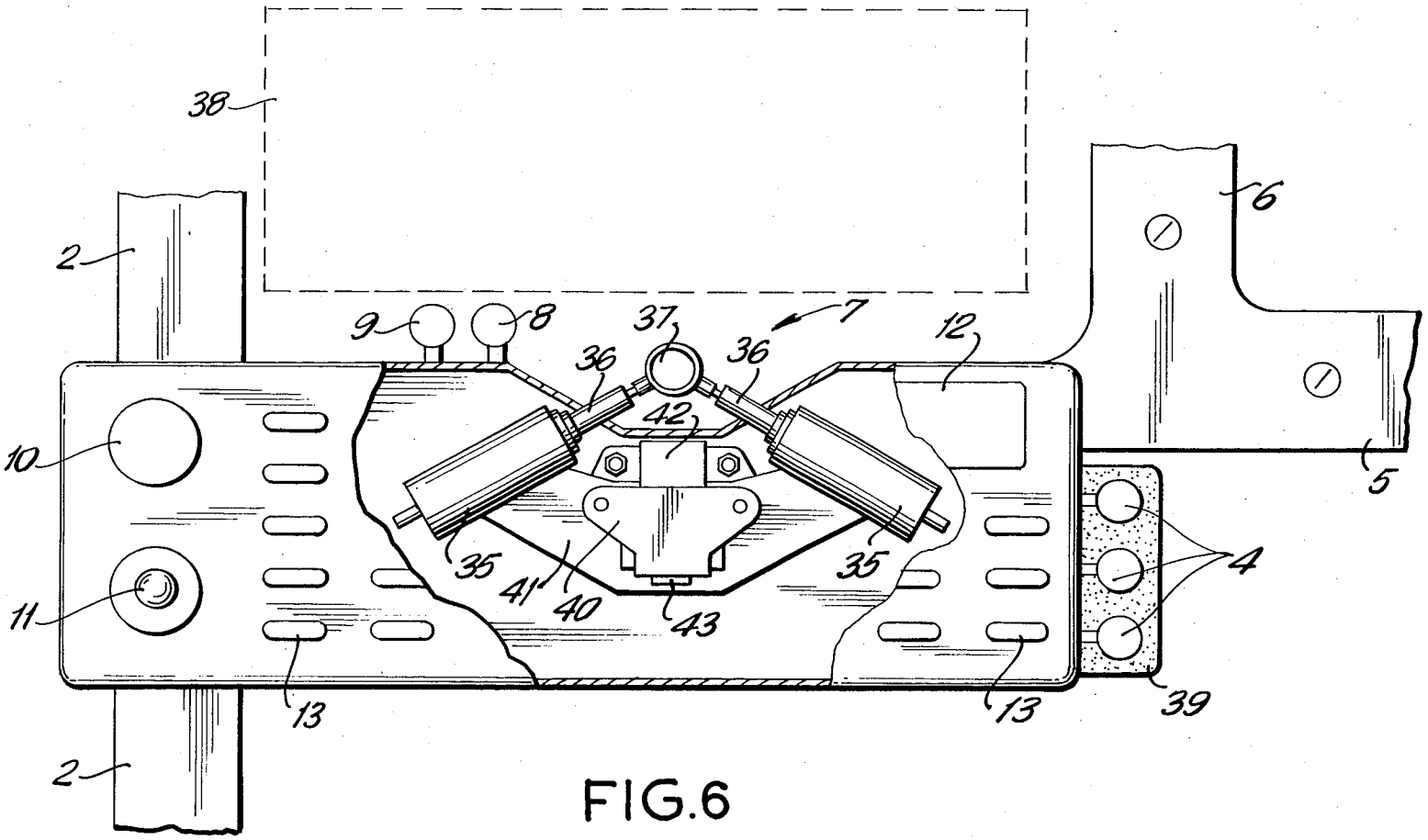
FIG. 6 is a partial broken-away plan view of the drafting head in the area of the $X_1$-$Y_1$ driving mechanism.

Aside from the guide carriage for moving on the guide path 2, the drafting head 3 contains a writing device, known, per se, such as are described in U.S. Pat. No. 4,197,550 and U.S. Pat. No. 4,455,751. The numerically controlled writing device comprises the $X_1$-$Y_1$ driving mechanism 7 equipped with two motors (see FIG. 6) and threaded spindles 36 moved by the latter. The two threaded spindles are, in turn, fastened at the receptacle 37 for the stylus so that by means of controlling the motors 35 of the computer 22, the threaded spindles 36 are rotated and the stylus receptacle 37 is correspondingly moved by means of this in the area of the writing field 38. The $X_1$-$Y_1$ driving mechanism 7, which receives one of the tubular pens or ink writers 4, in the stylus receptacle 37, serves to write and draw symbols, hatchings, curves, etc. Instead of the tubular pens 4, the writer receptacle 37 can also receive the adjusting lens 9 which projects at the front of the drafting head. With the aid of the adjusting lens 9 and, if desired, the X- Y- drive 1 and 2 via the movement sensor 11 and with the aid of the rotation sensor 10 or the $X_1$-$Y_1$ driving mechanism 7 via the keyboard 13, any desired point on the drafting base 15 can be reached in the most accurate manner by operation of the $X_1$-$Y_1$ driving mechanism 7 or the X-Y drive 1 and 2 in such a way that the point to be reached on the drawing medium, which is clamped on the drawing board 15, appears exactly in the reticule or cross hairs of the adjusting lens 9 so that components of the drawing can be put into the total drawing so as to be accurate with respect to dimensioning. If a symbol is to be drawn with a different line thickness, the stylus receptacle receives the corresponding ink writers 4 which are deposited laterally at the drafting head 3 in holders. In order to prevent the ink in the ink writers 4 from drying up, the latter are set aside on a rubber lip 39 corresponding to that shown in U.S. Pat. No. 4,455,751, should they not be in use. For sketches, a pencil 8 can also be received by the stylus receptacle instead of an ink writer.

During movement of the drafting head 3 by means of the above-described X- Y- drives 1 and 2, the styli 4 and 8 in the stylus receptacle 37 may not touch the drafting base, since undesired lines would otherwise occur on the drawing. In order to avoid such contact, a lifting mechanism is installed in the interior of the drafting head which raises the stylus holder 37 from the base. Such a lifting mechanism is comprised of a swivelable plate 40, below which a leaf spring 41 is mounted. Motors 35, which carry the stylus receptacle 37 by means of the threaded spindles 36, are located at the ends of the leaf spring 41. During the writing operation of the $X_1$-$Y_1$ driving mechanism 7, the plate 40 lies on the leaf spring 41 and holds down the latter so that the stylus located in the stylus receptacle 37 contacts the drawing base and draws the corresponding lines on the drawing. For non-writing movements of the stylus receptacle 37, the plate 40 is swiveled upward by means of a motor 42 with eccentric 43 in such a way that the leaf spring 41 also moves upward due to its inherent elasticity and accordingly lifts the stylus in the stylus receptacle 37 from the drafting base. If the non-writing movements are carried out or the drafting head has reached the desired position, then the plate 40 is swiveled back again so that the leaf spring 41 is pressed down and the stylus is placed on the drafting base again. The construction of such a swivelable plate is accordingly effected corresponding to the disclosure of the aforementioned patent, U.S. Pat. No. 4,455,751.

In addition to the parts already mentioned, i.e., movement sensor 11, rotation sensor 10, $X_1$-$Y_1$ driving mechanism 7 and numerically controlled writing device 7 with lifting mechanism, adjusting lens 9, pencil receiver 8 and tubular pens 4, which are arranged facing away from the hand of the operator in the near range of vision of the operator, the drafting head 3 also contains the indicator 12 and the keyboard 13. By means of the keyboard, the operator can select the desired symbols, hatchings, characters, etc. which are to be drawn. The dialogue between the writing device 7 and the operator is guided by means of the indicator 12. The indicator 12 and the keyboard 13 liekwise serve for the user's communication with the computer 22 described hereinafter.

The advantages of the invention are obvious. The operator can move to the point on the drafting base at which he would like to work with the aid of the movement sensor 11 and the rotation sensor 10. In this area, he has the availability of the rulers 5 and 6 in order to work on the customary drafting board. Frequently occurring symbols, drawing components, lettering, etc. can be drawn automatically in the work area 38 of the writing device with the $X_1$-$Y_1$ driving mechanism 7. Since the writing device 7 operates in its own work area 38, it is unnecessary to drive the entire drafting head 3 along during a drawing operation thereby reducing the time required.

Data for moving to determined points or places on the drafting base 15 by means of the X- Y- drives 1 and 2 or the $X_1$-$Y_1$ driving mechanism 7, as well as data for drawing symbols, letters, etc. can be fed manually through the keyboard 13 and can also be transmitted to the control of the drives by a computer provided with a corresponding program. In an advantageous manner, the control of the drives is taken over by programs in the computer itself. In addition, the logic of the drives is provided with known, standardized interfaces, e.g., RS 232 interfaces, in order to connect to a desired commercially available computer 22. Since only one drive is active at a time, either the drive 1 and 2 or the driving mechanism 7, this computer can be connected to the respective active drive. The structure of the connections of the computer with the individual components of the invention is illustrated in the block diagram of FIG. 7. The construction of such connections between the computer and the control of the devices themselves is within the knowledge of those skilled in the art and is therefore not discussed in further detail.

Figure 7:
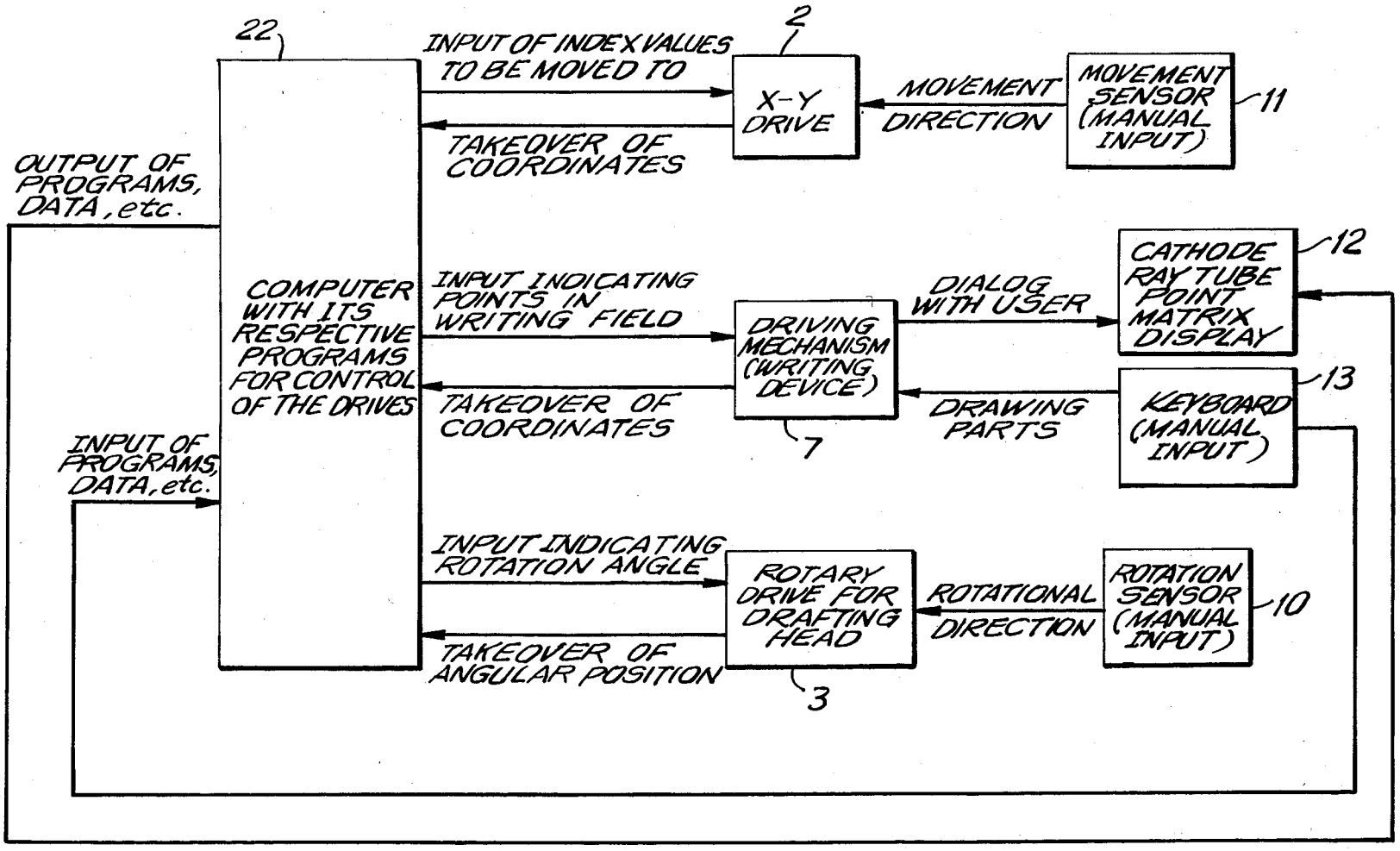
FIG. 7 is a block diagram showing the system for control of the individual drives and sensors by means of the computer.

As shown in FIG. 7, the computer 22 operates through a dialogue with the user in that data and instructions are given out on the indicator 12. The operator supplies corresponding data via the keyboard 13 for moving up to points in the writing field 38 by means of the stylus receptacle 37 or selects symbols, etc. The computer 22 accepts this input and sends the appropriate movement commands or pregiven points to the control of the $X_1$-$Y_1$ driving mechanism 7. The points which are correspondingly reached are reported back to the computer from the $X_1$-$Y_1$ driving mechanism 7 and the coordinates of these points can be fed out on the indicator 12 for the purpose of checking. Points to be reached can also be transmitted to the X- Y- drive 2 from the computer 22 so that this X- Y- drive 2 moves to the corresponding points on the drafting base 15. As already mentioned above, the X- Y- drives 2 can be directly moved with the movement sensor 11, wherein the coordinates of the points are determined with the aid of the sensors 31 and 32 and are transmitted to the computer 22 which, in turn, feeds them out of the indicator 12 for viewing by the operator. Rotations of the drafting head 3 can be carried out with the rotation sensor 10, wherein the rotation angles are likewise fed out to the indicator by means of the computer. Alternately, a rotation angle can be transmitted to the rotational drive in the drafting head by the program in the computer or by means of the keyboard 13. As can be clearly seen, accordingly, one and the same computer switches off precisely those drives, as needed.

As described, the user therefore advantageously has the possibility to draw with a computer-assisted drafting machine by hand in the conventional manner as well as automatically with the $X_1$-$Y_1$ driving mechanism 7, wherein the automatic drafting work is controlled by the computer 22 according to the manner of use more favorable in the individual case. However, the operator can also intervene manually during automatic drafting work through the sensors 10 and 11 to add drawing parts not provided in the program of the computer or to change the automatic cycle.

While a specific embodiment of the invention has been shown and described in detail to illustrate the application of the inventive principles, it will be understood that the invention may be embodied otherwise without departing from such principles.

What is claimed is:

1. A drafting machine comprising:

a drawing board for mounting a drawing thereon;

first guide path means for a first traveling carriage extending in the horizontal direction attached to said drawing board defining an X-axis;

second guide path means for a second traveling carraige extending in a vertical direction attached at said first traveling carriage defining a Y-axis;

a drafting head located at said second traveling carriage containing a straight edge receiving installation for attachment of straight edges to be rotatable and displaceable in any desired position on said drawing board by means of X-Y drives located in said first and second traveling carriages so that said drafting straight edges may be adjustable to any random angle with respect to said X- and Y- axes;

distance and angular measuring devices in said traveling carriage and at said drafting head;

computer means connected with said distance and angular measuring devices for determination of digital X-Y coordinates and of angles with respect to said X- and Y- axes of the position of said drafting head upon said drawing board;

display means at said drafting head for providing a display output of said X-Y coordinates and said angles determined by said computer means;

input keyboard means at said drafting head for enabling manual input of data into said computer;

X-Y drives for displacement of said drafting head upon said drawing board and for enabling rotational drive of said drafting head for rotating said drafting head on said drawing board;

displacement sensor and a rotational sensor connected with said computer means attached at said drafting head capable of being actuated by manual operation to actuate said computer means to issue appropriate control signals to said X-Y drives for displacement and rotation of said drafting head;

operational and travelling path programs for enabling selective control of all movements and rotation of said drafting head by manual operation instead of by said computer means;

an $X_1$ and $Y_1$ scriber on said drafting head having high dynamics and a small working range for lettering and small size symbols equipped with a receptacle for stencil pens or similar writing implements which are located in receptacles at said drafting head, said receptacle for said stencil pens being capable of executing any desired travel curve within the working range by means of said X-Y drives; and a lowering mechanism upon said drawing board whereby a writing implement contained in said receptacle can be lowered or lifted onto or off said drawing board in order to thus enable drawing of desired symbols by actuation of said X-Y drives and of said lowering mechanism with appropriate travel path information by said computer means with all operational and travel path programs for said drafting head as well as for said $X_1$-$Y_1$ scriber being called up at least by said input keyboard at said drafting head.

2. A drafting machine according to claim 1, wherein said displacement sensor issues an X-Y signal which is essentially proportional to the vectorial pressure corresponding to the direction of force of the hand of the operator, said signal being not or only negligibly dependent or the operational path and supplying the desired values to a sensitive servo control of the X-Y drives and supplying in said computer means desired values of a very sensitive servo contorl of aid X-Y drives.

3. A drafting machine according to claim 1, further comprising optical magnifier means for enabling adjustments to locations in the drawing area of said drafting machine, said magnifier means being atached at said drawing head in such a way that its location, in relation to a reference location of said drawing head, is a fixed quantity which is known to said computer means.

4. A drafting machine according to claim 1, wherein Cartesian corrdinates of the locations of all additional drawing tools, avaialbe at said drawing head including said $X_1$-$Y_1$ scriber, said receptable, intersection of drawing edges of said straight edge, and said stencil pen are known to said computer means.

5. A drafting machine according to claim 1, wherein the location coordinates which vary by necessity can be put in as variables of a coordinate correction program by means of said keyboard at said drafting head.

6. A drafting machine according to claim 1, wherein the X-, X', Y- drives of said traveling carriages and $Y_1$-$Y_1$ drives of the $X_1$-$Y_1$ scriber are designed to be self-locking against reversal of their effective direction in the zero current position.

7. A drafting machine according to claim 1, wherein a flat cathode-ray tube with 90° ray deflection is provided as a display unit at said drafting head.

8. A drafting head according to claim 1, further comprising third guide path means extending in the horizontal direction attached at said drawing board and a third traveling carriage arranged on said third guide path means, said traveling carriage being attached at said second guide path means with an X- drive being located at said third traveling carriage for improving the dynamics during movements of said drafting head in the direction of said X- axis.

* * * * *